United States Patent [19]

Wiese et al.

[11] 4,206,848

[45] Jun. 10, 1980

[54] INGOT MOLD CAP REMOVING AND HANDLING APPARATUS

[75] Inventors: Klaus H. Wiese, Rialto; James P. Sullivan, Upland, both of Calif.

[73] Assignee: Kaiser Steel Corporation, Oakland, Calif.

[21] Appl. No.: 937,054

[22] Filed: Aug. 28, 1978

[51] Int. Cl.[2] ..... B66C 13/00

[52] U.S. Cl. ..... 212/4; 254/131; 414/164

[58] Field of Search ..... 414/164; 212/4; 254/124, 131; 294/15, 17, 67 A

[56] References Cited

U.S. PATENT DOCUMENTS

| | | | |
|---|---|---|---|
| 2,142,447 | 1/1939 | Krall | 212/4 |
| 2,655,399 | 10/1953 | McMillan | 294/17 |
| 2,667,276 | 1/1954 | Peterson | 212/4 |
| 2,718,311 | 9/1955 | Cain | 212/4 |
| 2,814,394 | 11/1957 | Witcher | 414/743 |
| 3,805,975 | 4/1974 | Feldhaus | 212/4 X |
| 3,848,850 | 11/1974 | Bemis | 254/124 X |
| 3,861,649 | 1/1975 | Mosley | 254/124 |
| 3,885,688 | 5/1975 | Larsen | 254/131 X |
| 4,036,474 | 7/1977 | Owan | 254/124 |

FOREIGN PATENT DOCUMENTS

| | | | |
|---|---|---|---|
| 158548 | 4/1940 | Fed. Rep. of Germany | 212/4 |

*Primary Examiner*—L. J. Paperner

*Attorney, Agent, or Firm*—Naylor, Neal & Uilkema

[57] ABSTRACT

A lever of the second class is employed to prise a mold cap free of an ingot mold by tipping the cap about a point on its periphery which is in engagement with the mold mouth. The lifting lever is operated by a power cylinder. A carrier for the lever and its power cylinder is provided to transfer the mold cap from the mold to the pouring platform and back to the mold.

8 Claims, 5 Drawing Figures

INGOT MOLD CAP REMOVING AND HANDLING APPARATUS

PRIOR ART

U.S. Pat. Nos. 2,667,276, 2,718,311, 2,814,394 and 4,009,081 are known to applicants. None of them discloses ingot mold cap handling apparatus which is adapted to first tip and then lift a mold cap.

SUMMARY OF THE INVENTION

The principal object of the invention is to provide apparatus of the subject type which is adapted to remove mold caps by tipping them and which is therefore particularly efficient in the removal of caps that are "stickers", that is, caps which are bonded by molten steel or other substance to the top of a bottle top mold.

Other objects and advantages of the invention will be apparent from the following description taken in conjunction with the drawings forming part of this specification, and in which.

DESCRIPTION OF THE INVENTION

Figure 1:
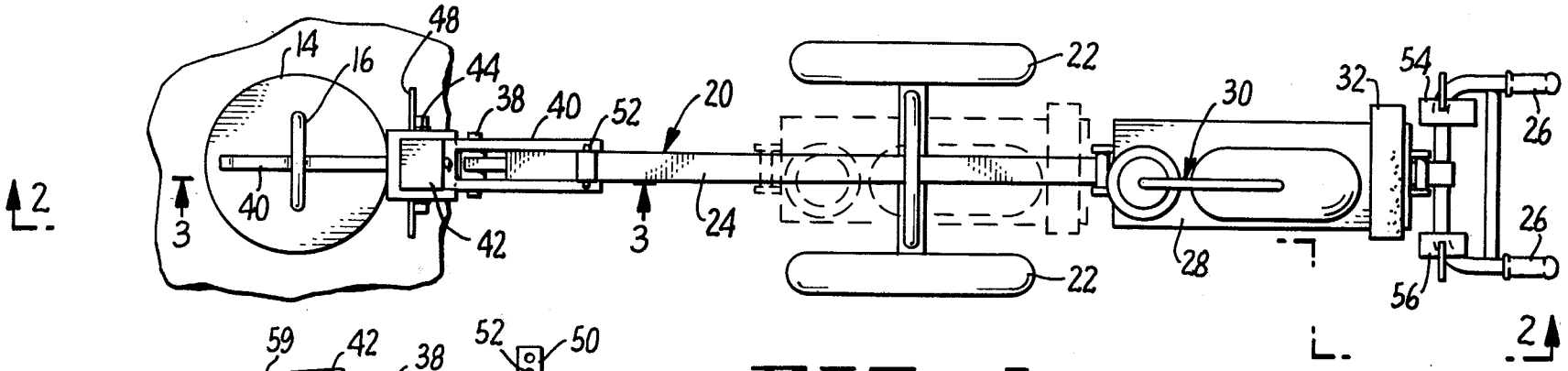
FIG. 1 is a top plan view of one embodiment of the apparatus of the invention.

The drawings show a pouring platform 10, a bottle top ingot mold 12 which is provided with a removable cap 14 having a handle or lifting eye 16. Molten steel is poured into such molds normally to the level 18—18. The caps 14 are put in place right after the pouring operation and serve to confine the gasses from the molten steel within the mold and thereby control the size and shape of the cavities formed along the axes of the ingots as the steel solidifies. The removal of the caps normally commences when the upper surfaces 18—18 of the ingots start to solidify.

Figure 2:
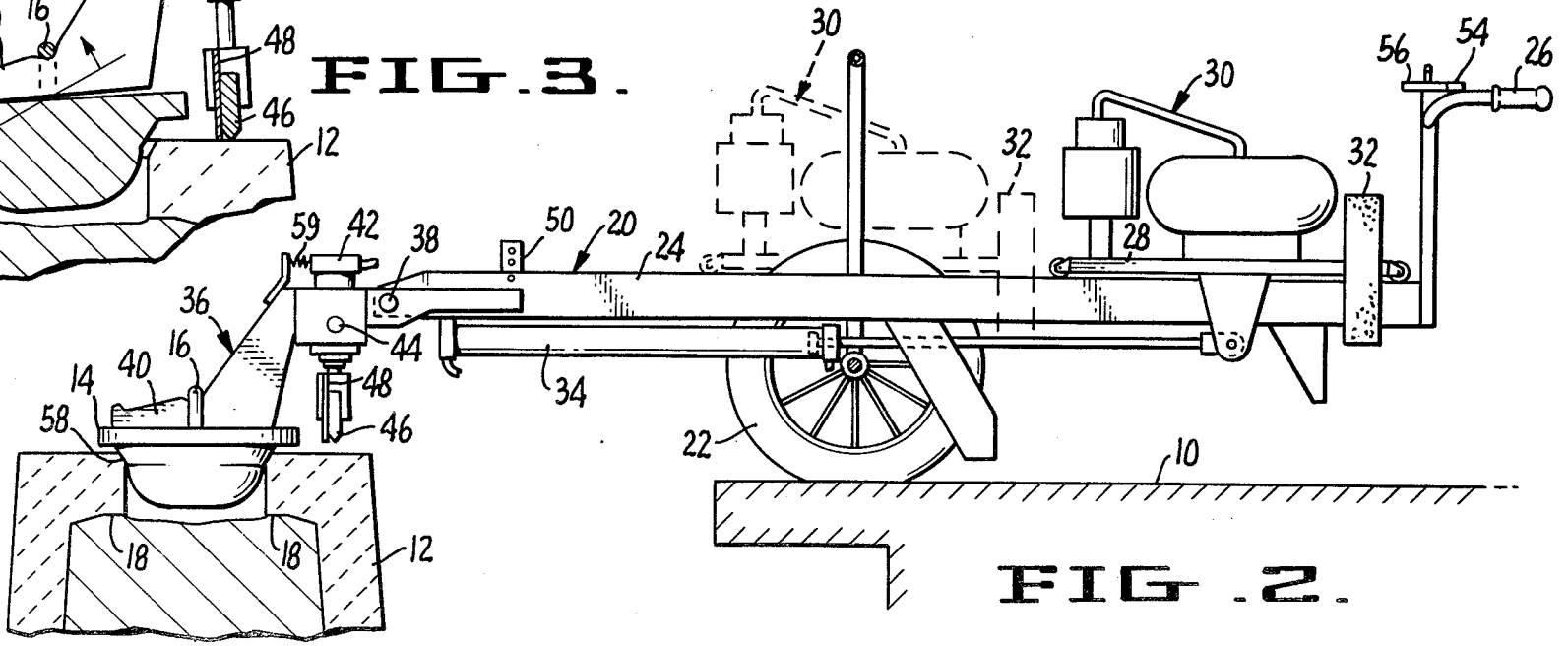
FIG. 2 is a view taken along lines 2—2 of FIG. 1.
Figure 3:
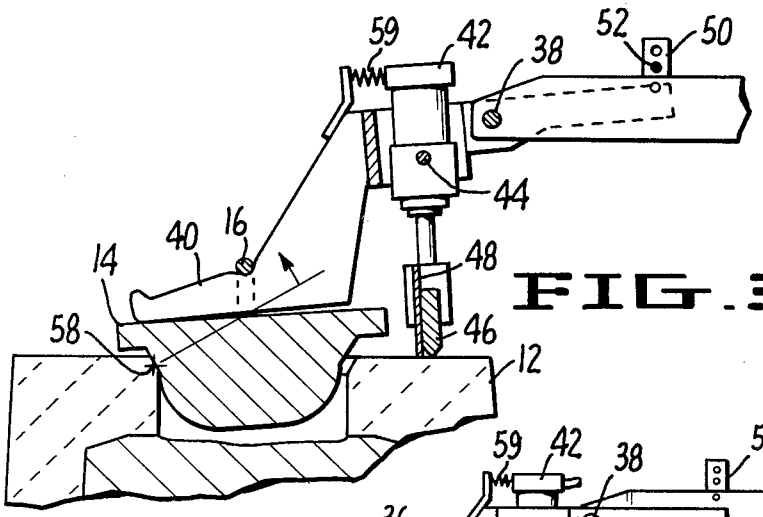
FIG. 3 illustrates the apparatus of FIG. 2 in the course of a cap removal operation.

The apparatus of FIGS. 1–3 includes a carriage 20 comprising wheels 22, boom 24, handlebars 26 for the guidance of the carriage, a platform 28 slidably mounted on boom 24 and carrying power pack 30 and counterweight 32, a power cylinder 34 to shift the plaform between the solid outline and dotted outline positions shown, and a lever-cylinder assembly 36 having a pivotal connection 38 with the boom 24.

The lever-cylinder assembly 36 comprises a lever 40 adapted to be inserted into cap handle 16, power cylinder 42 having a pivot pin connection 44 with lever 36, the latter having a pivot pin connection 38 with boom 24, a yoke member 46 carried by the rod of cylinder 42, and a shield 48 carried by the cylinder rod to protect the operator as the cap is broken loose and lifted.

The apparatus additionally comprises a multi-aperture stop pin holder 50 carried by boom 24 and a stop pin 52 selectively positionable in the holder 50 to limit to a predetermined degree the pivot of the lever-cylinder assembly 36 relative to the boom 24 during a cap removal and lifting operation.

The apparatus further comprises a control 54 for the power cylinder 42 and a control 56 for the power cylinder 34.

The operation of the apparatus of FIGS. 1–3 is as follows, assuming that the cap 14 is in place and is now to be removed from the mold 12. The carriage is moved at a right angle to the front edge of the platform 10 to engage the lever 40 beneath the cap handle 16 and to position the yoke on the top of the mold 12. The cylinder 42 is then energized to push the yoke 46 against the top of the mold and thereby cause an upward pivotal movement of the cap about the point 58 to break the cap free from the mouth of the mold. The combined upward and rocking movement of the lever 40 is accompanied by a combined upward and rocking movement of the leading end of boom 24 to cause the lever to engage the stop pin 52. By this time the cap has been broken free from the mold mouth. Further operation of the cylinder 42 causes lever 40 and the forward end of the boom to be lifted upwardly together to lift the cap fully out of the mold mouth. The carriage is then manually swung around and the cap is deposited on the pouring platform 10.

The lever-cylinder assembly 36 produces approximately a 3:1 multiplication of force. In practice, the yoke 46 will be pushed down against the top of the mold with a force that can reach 16,000 lbs., producing an upward force on the cap handle 16 of up to 50,000 lbs. depending upon the resistance encountered.

The re-setting of the cap on the mold is accomplished by operating the apparatus in reverse order to the order described above.

In order to operate the apparatus with minimum manual effort on the part of the operator, e.g. so that he can swing the cap-loaded apparatus to place the cap on the platform 10 and to replace the cap on the mold by exerting approximately 45 lbs. of manual effort, the platform 28 is set in the solid line position in order to counter-balance the additional weight effect of the cap, whereas when a cap is not being carried by the lever 40 the apparatus is effectively balanced about the axis of the wheels 22 by the positioning of the platform in the dotted line position.

Spring 59 tends to maintain the cylinder 42 in the upright position of FIG. 1 relative to the lever 40.

Figures 4, 5:
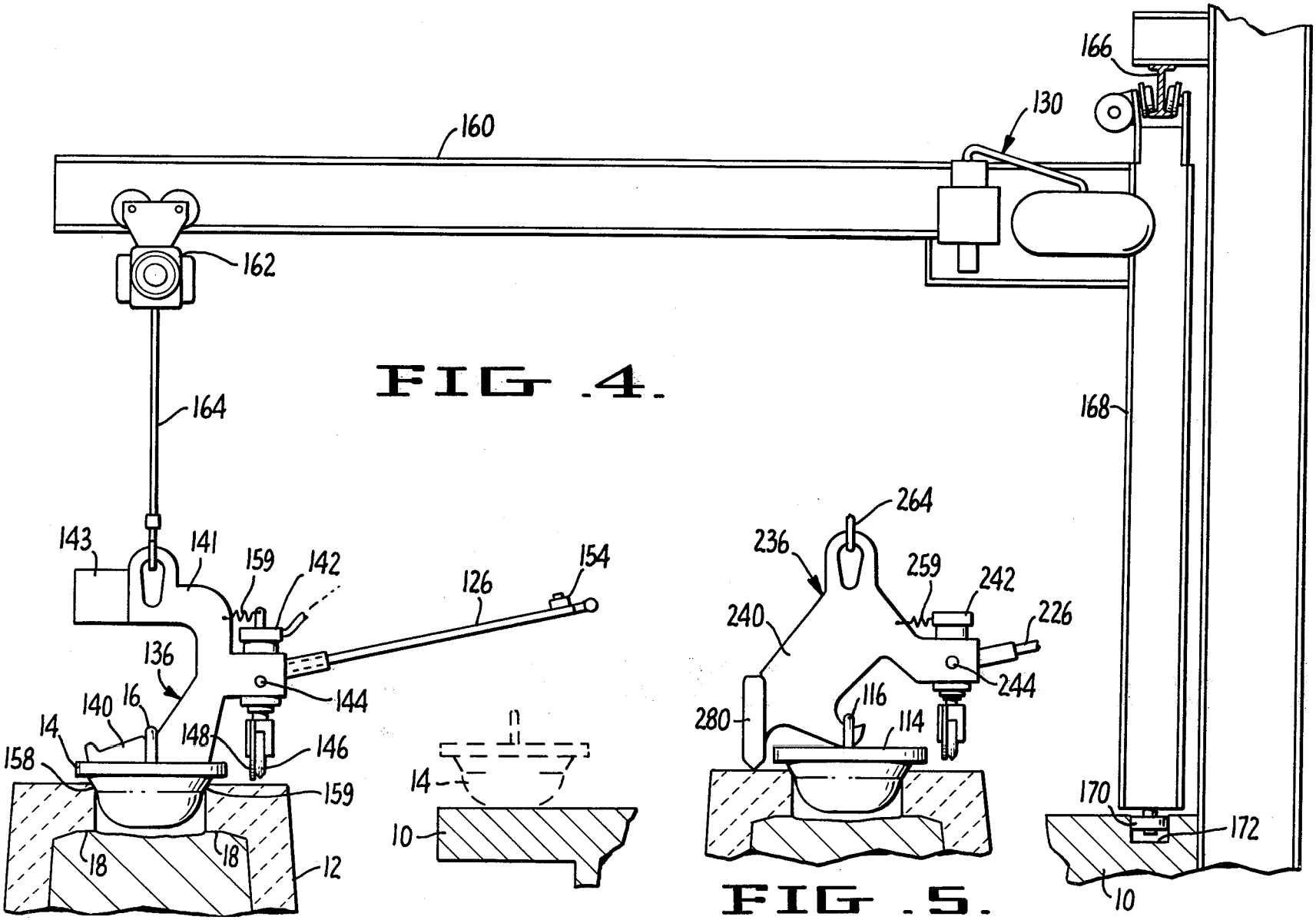
FIG. 4 is view in side elevation of apparatus constituting a further embodiment of the invention.
FIG. 5 is a view in side elevation of apparatus constituting still a further embodiment of the invention.

A modified form of the apparatus of the invention is shown in FIG. 4. Here the lever-cylinder assembly 136 comprises lever 140, power cylinder 142, pivot pin connection 144 between the lever and the cylinder, yoke 146, shield 148, operating guide rod or handle 126, control 154 for operation of cylinder 142, a support arm 141 for lever 140 integral therewith and a counterweight 143 carried by the support arm 141 for balancing the lever-cylinder assembly. A carrier for the lever-cylinder assembly comprises monorail 160, traveling hoist 162 carried by the monorail, a cable connector 164 between the hoist 162 and the support arm 141, a lateral monorail 166 and a carriage 168 which carries monorail 160, is suspended from monorail 166, and is supported and guided by guide rollers 170 which travel within a guide channel 172.

The power pack 130 for cylinder 142 is shown as being attached to the carriage 160, 168.

Assuming that the cap 14 is ready for removal and that the apparatus is positioned as shown in FIG. 4, the operation of this embodiment is as follows. The operator energizes the cylinder 142 to cause the yoke 146 to be forced against the upper end of the mold and to cause lever 140 to be rotated in a counter-clockwise direction about a pivot point generally indicated at 158. As was the case with the embodiment of FIGS. 1–3, this causes the cap to break free from the mold mouth first at the point 159 and progressively to point 158. The hoist 162 is then energized to lift the lever-cylinder assembly and the cap so that the latter is fully out of the mouth of the mold. Following this, the operator pulls the apparatus including the hoist 162 over to the pouring platform 10, deposits the removal cap on the platform, and moves the apparatus along the platform for subsequent cap handling at an adjacent mold.

In view of the fact that the considerable force of approximately 50,000 lbs. which is necessary to separate a "sticker cap" from a mold is provided by the particular combination of lever 140 and cylinder 142, a light hoist 162 may be used to carry the lever-cylinder assembly and removed cap.

An alternate form of lever-cylinder assembly, usable with each of the above-described embodiments, is shown in FIG. 5. Parts corresponding to those of FIG. 4 are indicated by corresponding reference numerals plus one hundred. The differences between the lever-cylinder assembly of FIG. 5 and that of FIG. 4 are that the former is provided with a simple hook connection with the cap handle and is provided with a fulcrum member 280 which engages the top of the mold at the other side of the cap. Upon energization of cylinder 242, lever 240 is rocked in a counter-clockwise direction about the line of engagement between the fulcrum member 280 and the mold top. In practice the lever-cylinder assemblies of FIGS. 4 and 5 are both capable of providing a vertically upward lifting force of about 50,000 lbs. at the cap handle.

What is claimed is:

1. Apparatus for removing, handling and replacing ingot mold caps having lifting eyes, said apparatus comprising a lever member adapted to extend transversely across the top of a mold cap and to extend beneath the lifting eye of a cap in connected, lifting relation thereto, fulcrum means for the lever member adapted to be disposed to one side of a cap at the top of an ingot mold, and power means to move the lever member upwardly about the fulcrum means and thereby tip the cap upwardly and progressively break it free of engagement with a mold, the power means comprising a power cylinder connected to the lever member and operable when energized to bear against the top of the mold at the opposite side of the cap and move the lever member about the fulcrum means, the power cylinder being pivotally connected to the lever member, the spring means positioning the power cylinder in an upright position relative to the lever member as the lever member is brought into connected lifting relation to the cap.

2. Apparatus for removing, handling and replacing ingot mold caps having lifting eyes, said apparatus comprising a lever member adapted to extend transversely across the top of a mold cap and to extend beneath the lifting eye of a cap in connected, lifting relation thereto, fulcrum means for the lever member adapted to be disposed to one side of a cap at the top of an ingot mold, power means to move the lever member upwardly about the fulcrum means and thereby tip the cap upwardly and progressively break it free of engagement with a mold, the power means comprising a power cylinder connected to the lever member and operable when energized to bear against the top of the mold at the opposite side of the cap and move the lever member about the fulcrum means, and carrier means for the lever member and power cylinder operable to transfer the lever member and cylinder and cap between the mold and a pouring platform, the carrier means comprising an elongated boom supported by a pair of wheels adapted to be disposed on a pouring platform, the boom having handlebars at its platform end whereby it may be manually maneuvered randomly about the platform, the boom having its other end pivotally connected to the lever member whereby energization of the power cylinder to move the lever member upwardly also imparts upward movement to the other end of the boom about the wheels.

3. The apparatus of claim 2, including stop means operable after a predetermined degree of upward movement of the lever member and the boom to lock the lever member and boom together for further movement conjointly to effect full disconnection of the cap from the mold and for transfer of the cap to the pouring platform.

4. The apparatus of claim 3, said stop means being selectively adjustable to adapt the apparatus for use with molds of varying heights.

5. The apparatus of claim 4, including counter-weight means mounted on the boom for positioning near to and remote from the wheels for, respectively, counterbalancing the apparatus without a cap supported by the lever member and with a cap supported by the lever member.

6. The apparatus of claim 5, including a power cylinder carried by the boom and connected to the counterweight means for the positioning thereof along the boom, and separate control means carried by the handlebars for said power cylinders.

7. Apparatus for removing, handling and replacing ingot mold caps having lifting eyes, said apparatus comprising a lever member adapted to extend transversely across the top of a mold cap and to extend beneath the lifting eye of a cap in connected, lifting relation thereto, fulcrum means for the lever member adapted to be disposed to one side of a cap at the top of an ingot mold, power means to move the lever member upwardly about the fulcrum means and thereby tip the cap upwardly and progressively break it free of engagement with a mold, the power means comprising a power cylinder connected to the lever member and operable when energized to bear against the top of the mold at the opposite side of the cap and move the lever member about the fulcrum means, and carrier means for the lever member and power cylinder operable to transfer the lever member and cylinder and cap between the mold and a pouring platform, the carrier means comprising a monorail-mounted overhead power hoist having a cable connection with the lever member and being adapted to travel between a mold and a pouring platform, and handle means connected to the lever member and cylinder assembly comprising a guide rod adapted to extend from a mold over a pouring platform.

8. Apparatus for removing, handling and replacing ingot mold caps having lifting eyes, said apparatus comprising a lever member adapted to extend transversely across the top of a mold cap and to extend beneath the lifting eye of a cap in connected, lifting relation thereto, fulcrum means for the lever member adapted to be disposed to one side of a cap at the top of an ingot mold, and power means to move the lever member upwardly about the fulcrum means and thereby tip the cap upwardly and progressively break it free of engagement with a mold, the power means comprising a power cylinder connected to the lever member and operable when energized to bear against the top of the mold at the opposite side of the cap and move the lever member about the fulcrum means, said lever member comprising a foot portion having a tapered, notched upper side adapted to extend through and be engaged with the lifting eye of a cap and having an underside adapted to engage the top of a cap along a substantial part of the diameter thereof, said fulcrum means comprising a line of engagement between the cap and mold which is in line with said foot portion.

* * * * *